US010184630B1

(12) United States Patent
Wang

(10) Patent No.: US 10,184,630 B1
(45) Date of Patent: Jan. 22, 2019

(54) DOUBLE-LAYER DECORATIVE LAMP

(71) Applicant: Hua-Cheng Pan, Tainan (TW)

(72) Inventor: Chih-Liang Wang, Tainan (TW)

(73) Assignee: Hua-Cheng Pan, Tainan (TW)

( * ) Notice: Subject to any disclaimer, the term of this patent is extended or adjusted under 35 U.S.C. 154(b) by 0 days.

(21) Appl. No.: 15/865,279

(22) Filed: Jan. 9, 2018

(51) Int. Cl.

| | |
|---|---|
| ***F21S 13/02*** | (2006.01) |
| ***F21S 8/00*** | (2006.01) |
| ***F21V 33/00*** | (2006.01) |
| ***F21V 19/00*** | (2006.01) |
| ***F21S 2/00*** | (2016.01) |
| ***F21S 10/02*** | (2006.01) |
| ***F21V 21/02*** | (2006.01) |

(52) U.S. Cl.
CPC ..... *F21S 13/02* (2013.01); *F21S 2/005* (2013.01); *F21S 8/035* (2013.01); *F21S 10/02* (2013.01); *F21V 19/0025* (2013.01); *F21V 21/02* (2013.01); *F21V 33/0032* (2013.01)

(58) Field of Classification Search
CPC .. F21S 13/02; F21S 10/02; F21S 2/005; F21S 8/035; F21V 21/02; F21V 33/0032; F21V 19/0025
See application file for complete search history.

(56) References Cited

U.S. PATENT DOCUMENTS

| | | | | |
|---|---|---|---|---|
| 3,818,212 | A * | 6/1974 | Rochford | F21S 8/035 362/644 |
| 4,714,984 | A * | 12/1987 | Spector | F21S 8/035 362/101 |
| 5,887,802 | A * | 3/1999 | Yousefzadeh | F21S 8/035 248/220.21 |
| 8,303,158 | B2 * | 11/2012 | Chien | G09F 9/33 362/249.02 |
| 2005/0185402 | A1 * | 8/2005 | Hsu | F21S 8/035 362/257 |
| 2006/0152946 | A1 * | 7/2006 | Chien | A61L 9/03 362/641 |
| 2008/0074873 | A1 * | 3/2008 | Lin | F21S 8/035 362/235 |
| 2012/0257418 | A1 * | 10/2012 | Fields | F21S 8/035 362/641 |
| 2013/0320860 | A1 * | 12/2013 | Muromura | H05B 37/02 315/151 |

* cited by examiner

*Primary Examiner* — David V Bruce
(74) *Attorney, Agent, or Firm* — Leong C. Lei

(57) ABSTRACT

A double-layer decorative lamp mainly includes a lamp seat, cover unit and light emitting module, where the cover unit has at least two decorative board pervious to light and configured on the lamp seat, and the light emitting module is in electric connection with the lamp seat and has at least two light sources respectively corresponding to each decorative board, where one of the light sources is formed a proper angle with the corresponding decorative board, and the surface of each decorative board has shading pattern. Whereby, light of the each light source is passed through one of the decorative boards, allowing the non-shading pattern thereof to be brightened, and projects the non-shading pattern of another decorative board obliquely to a wall surface.

8 Claims, 10 Drawing Sheets

DOUBLE-LAYER DECORATIVE LAMP

TECHNICAL FIELD OF THE INVENTION

The present invention relates to a decorative lamp, and more particularly to a decorative lamp having a double-layer decorative board and projection effect.

DESCRIPTION OF THE PRIOR ART

In order to create a different atmosphere, there are many kinds of lighting capable of atmosphere change available in the market for people to choose. However, conventional lighting usually uses vertical lights, chandeliers for illumination, which may beautify indoor environment, but only has changes in outlooks, looking narrow in function and occupying space.

SUMMARY OF THE INVENTION

The main object of the present invention is to provide a decorative lamp design having a double-layer decorative board and projection effect, and further to promoting product competitiveness.

To achieve the object mentioned above, the present invention proposes a double-layer decorative lamp, including: a lamp seat, having an engagement portion and electrical terminal in connection with a power source to generate power; a cover unit, having a first decorative board pervious to light and configured on said engagement portion and at least one second decorative board pervious to light and configured on said engagement portion and positioned at any side of said first decorative board, surfaces of said first decorative board and second decorative board each having a shading pattern; and a light module, having a substrate, first light source configured on said substrate and emitting light toward said first decorative board and a second light source emitting light toward said second decorative board and formed a proper angle with said surface of said second decorative board, and said substrate configured on said lamp seat and in electric connection with said electrical terminal.

Therefore, the light generated from the light emitting module is used to brighten the non-shading pattern of the first decorative board, and project the non-shading pattern of the second decorative board obliquely to the wall surface, allowing the present invention to have a double lighting effect, and further promoting product competitiveness.

DETAILED DESCRIPTION OF THE PREFERRED EMBODIMENTS

Figure 1:
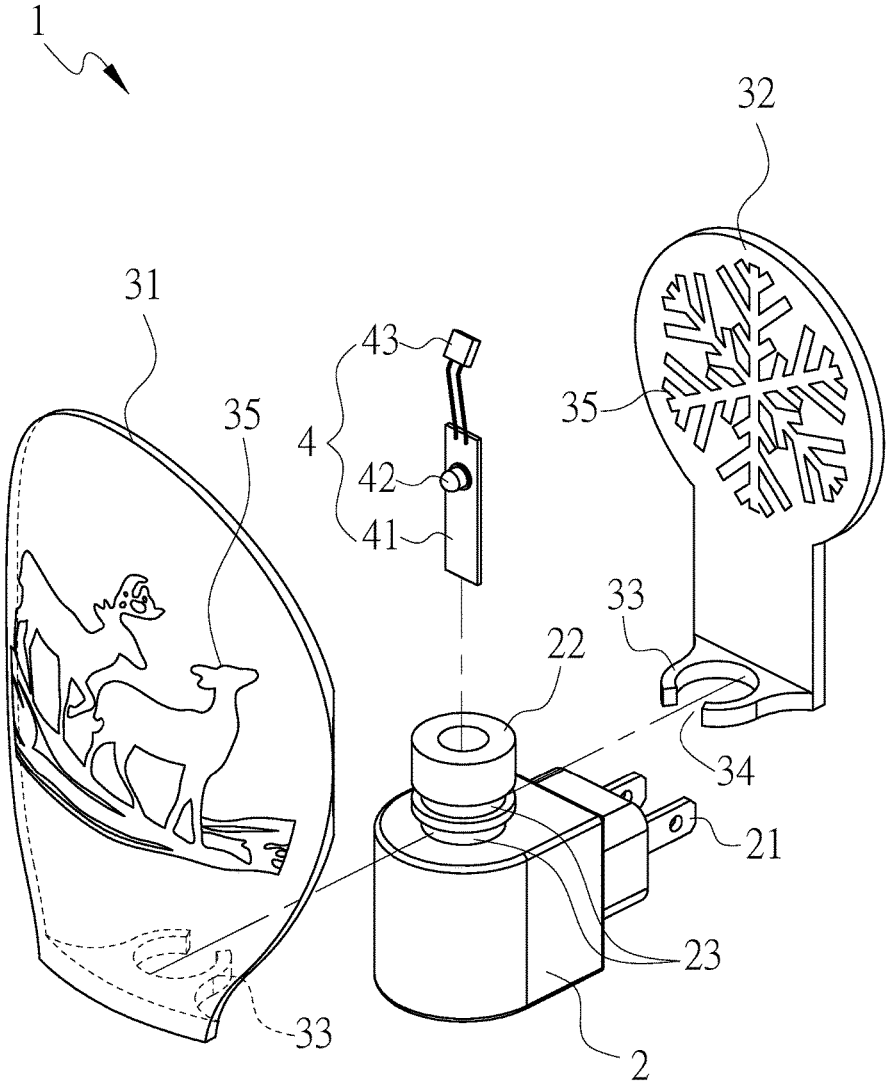
FIG. 1 is an exploded view of the present invention.

Referring to FIGS. 1 to 5, a double-layer decorative lamp 1 of the present invention mainly includes a lamp seat 2, cover unit 3 and light emitting module 4, where the light emitting module 4 and cover unit 3 are configured on the upper side of the lamp seat 2.

One side of the lamp seat 2 has an electrical terminal 21 in connection with a power source to generate power, which may be a plug or battery holder. In the embodiment, the lamp seat 2 is described as a night lamp seat, but the present invention is not so limited. The lamp seat 2 is configured upward with a hollow engagement portion 22, the outer edge of which is configured with at least one groove 23. In the embodiment, the grooves 23 are spaced apart from each other and number 2.

Figure 2:
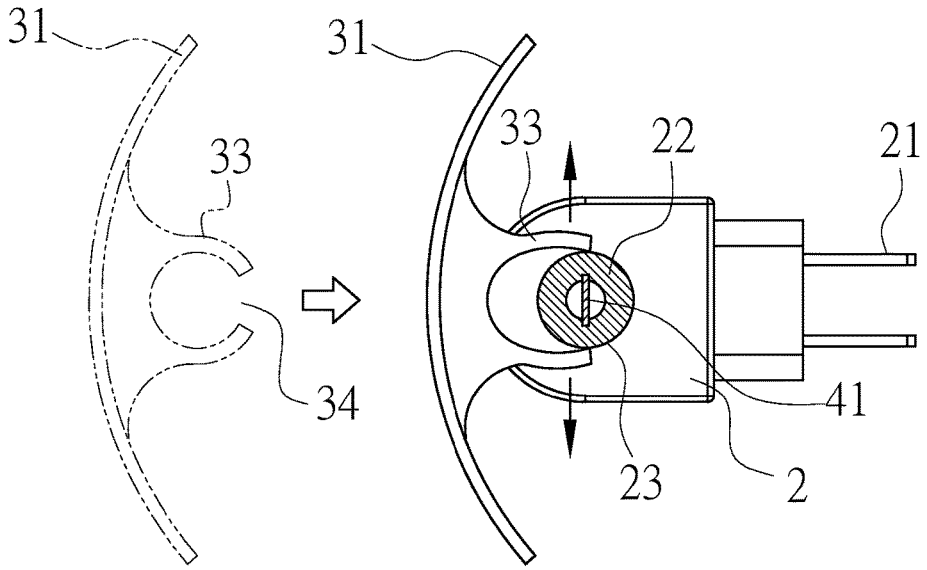
FIG. 2 is schematic view of the present invention.
Figure 3:
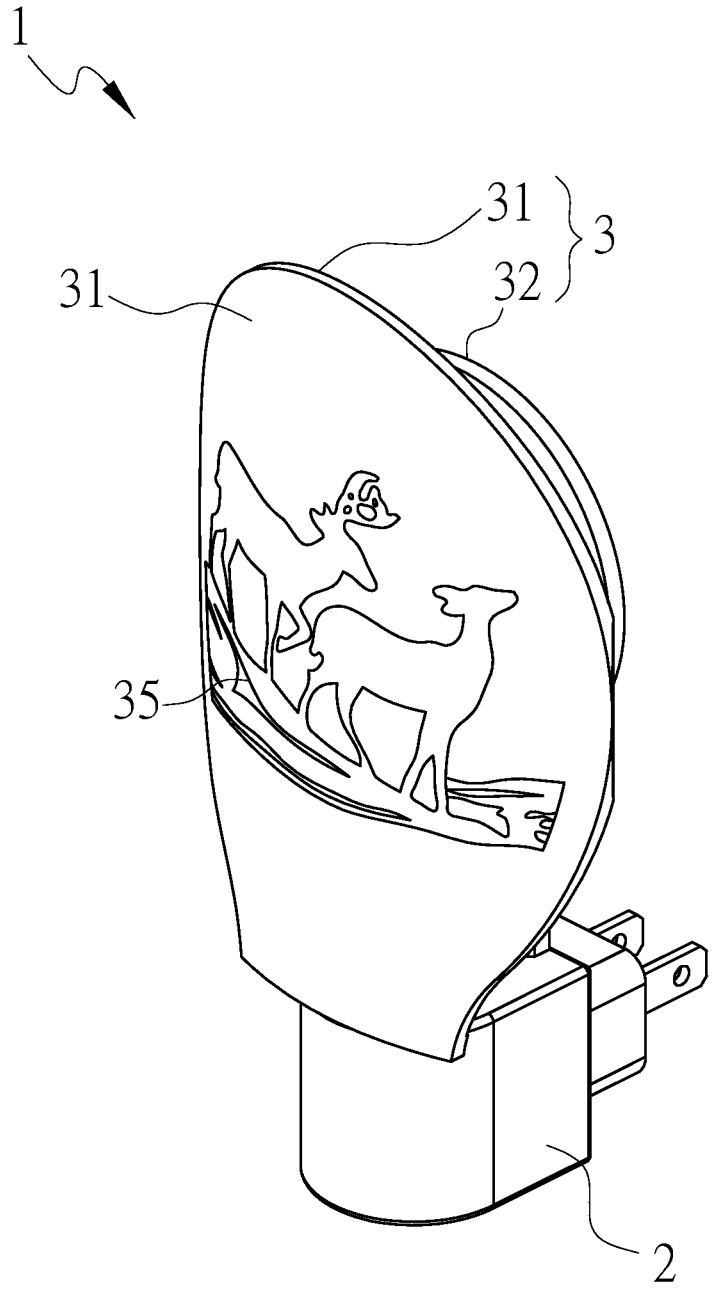
FIGS. 3 and 4 respectively are a perspective view of the present invention.
Figure 4:
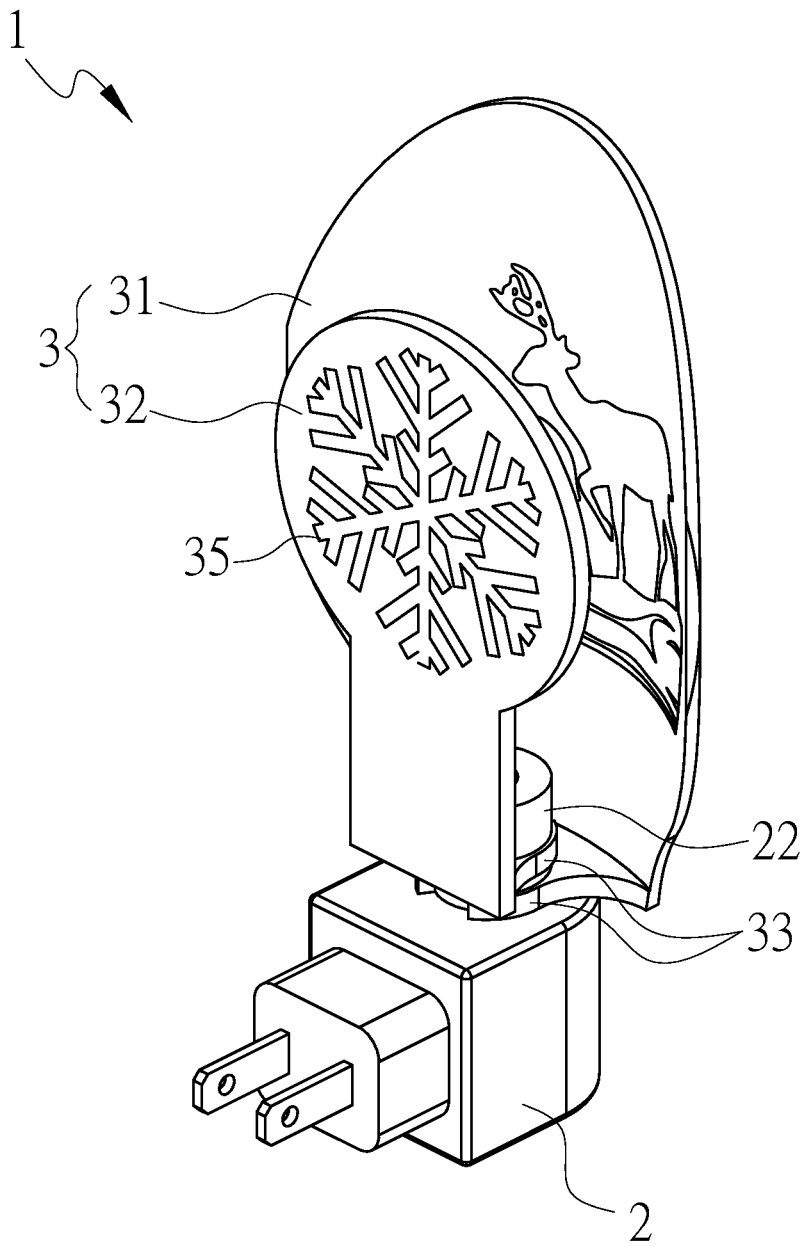
Figure 5:
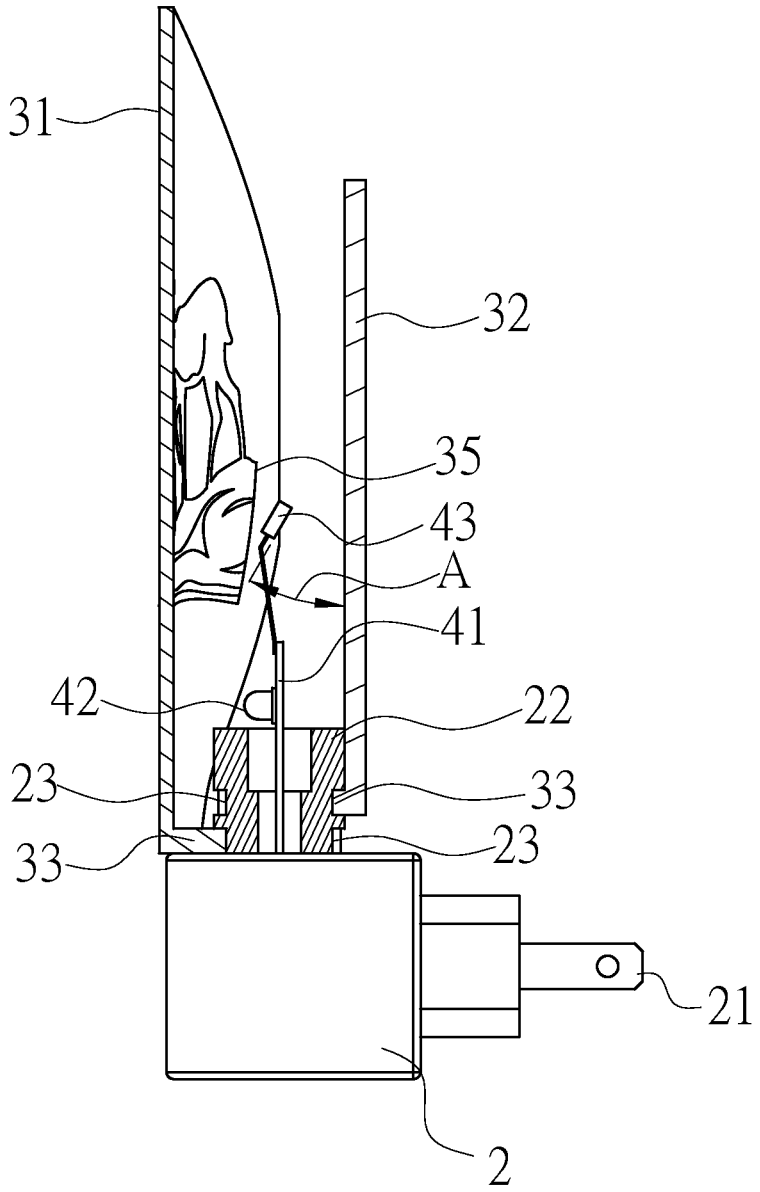
FIG. 5 is a cross-sectional view of the present invention.

The cover unit 3 has a first decorative board 31 pervious to light and at least one second decorative board 32 pervious to light, where the first decorative board 31 and second decorative board 32 are respectively configured on the engagement portion 22, and the second decorative board 32 is positioned at any side of the first decorative board 31. The manner that the first decorative board 31 and second decorative board 32 is in engagement with the engagement portion 22 is not limited; they may be extended upward integrally from the peripheral of the engagement 22 or in engagement with the engagement portion 22 by means of screwing, buckling or adhering. For example, the bottoms of the first decorative board 31 and second decorative board 32 are respectively extended transversely with a clamping portion 33 having two arc-shaped bodies symmetrical to each other, where the front end of the clamping portion 33 has a gap 34; the first, second decorative boards 31, 32 are respectively in engagement with the corresponding groove 23 of the engagement portion 22 with the gap 34 on the front end of the clamping portion 33, where the width of the gap 34, as FIG. 2 shows, is smaller than the outer diameter of the groove 23 so that the clamping portions 33 of the first, second decorative boards 31, 32 are respectively opened outwardly because of the elasticity thereof and engaged with the corresponding grooves 23, and the clamping portions 33 are then clamped on them in whole and fixed there. Furthermore, the surfaces of the first decorative board 31 and second decorative board 32 respectively are a t shading pattern 35. In the embodiment, the shading pattern 35 of the first decorative board 31 is animals, and the shading pattern 35 of the second decorative board 32 snowflakes, but the present invention is not so limited. In addition, the present invention does not limit the material of the shading pattern 35; it may for example be an opaque sticker or formed by means of spray-painting or electroplating.

The light emitting module 4 has a substrate 41, a first light source 42 configured on the substrate 41 and emitting light toward the first decorative board 31, and a second light source 43 emitting light toward the second decorative board 32 and formed a proper angle A with the surface of the second decorative board 32, where the substrate 41 is configured inside the engagement portion 22 of the lamp seat 2 and in electric connection with the electrical terminal 21. in the embodiment, the first light source 42 and second light source 43 respectively are a light emitting diode (LED), the color change, light emitting time or flashing frequency thereof can be controlled by the substrate 41.

Figure 6:
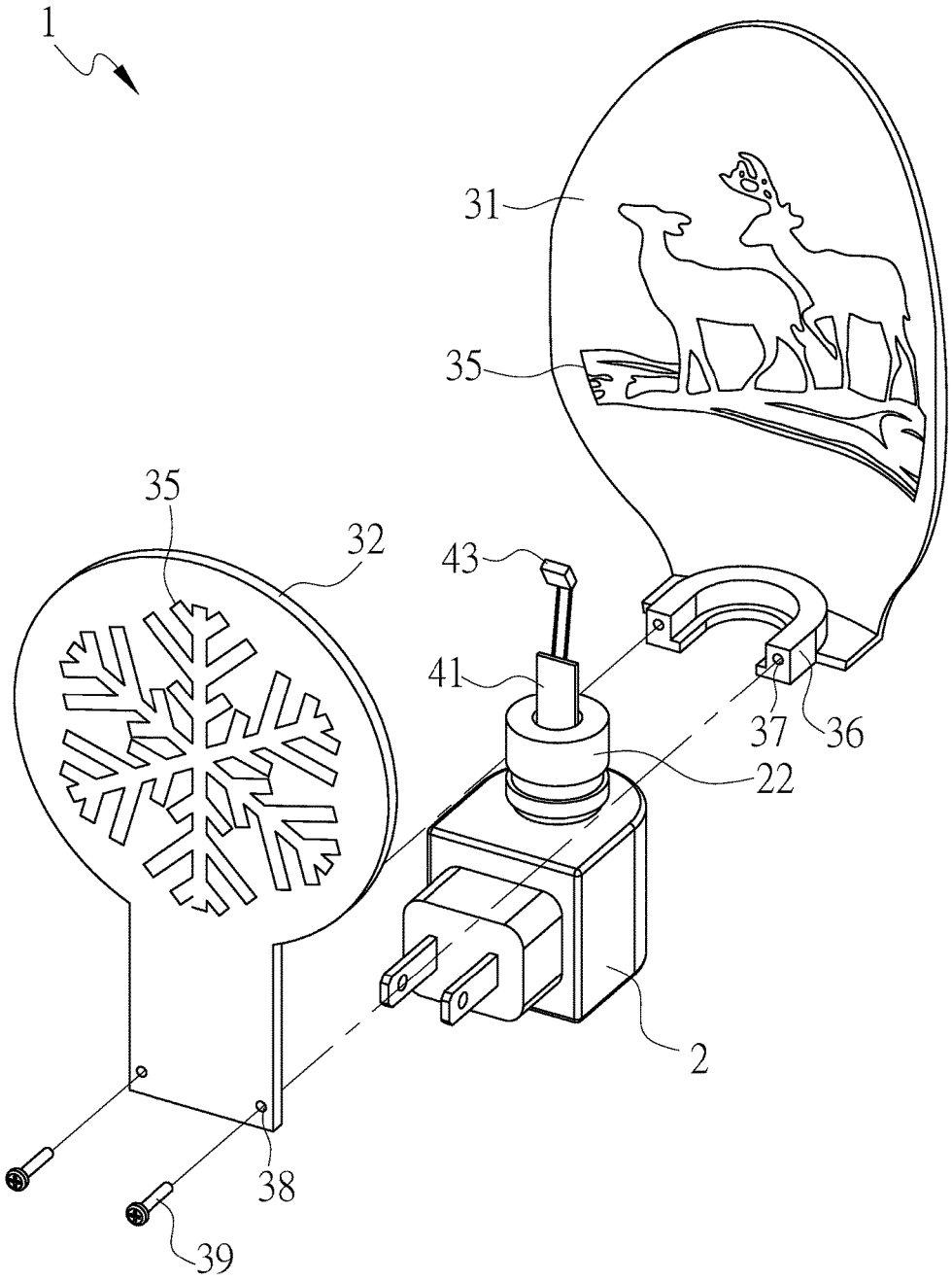
FIG. 6 is an exploded view of a preferred embodiment of the present invention.
Figure 7:
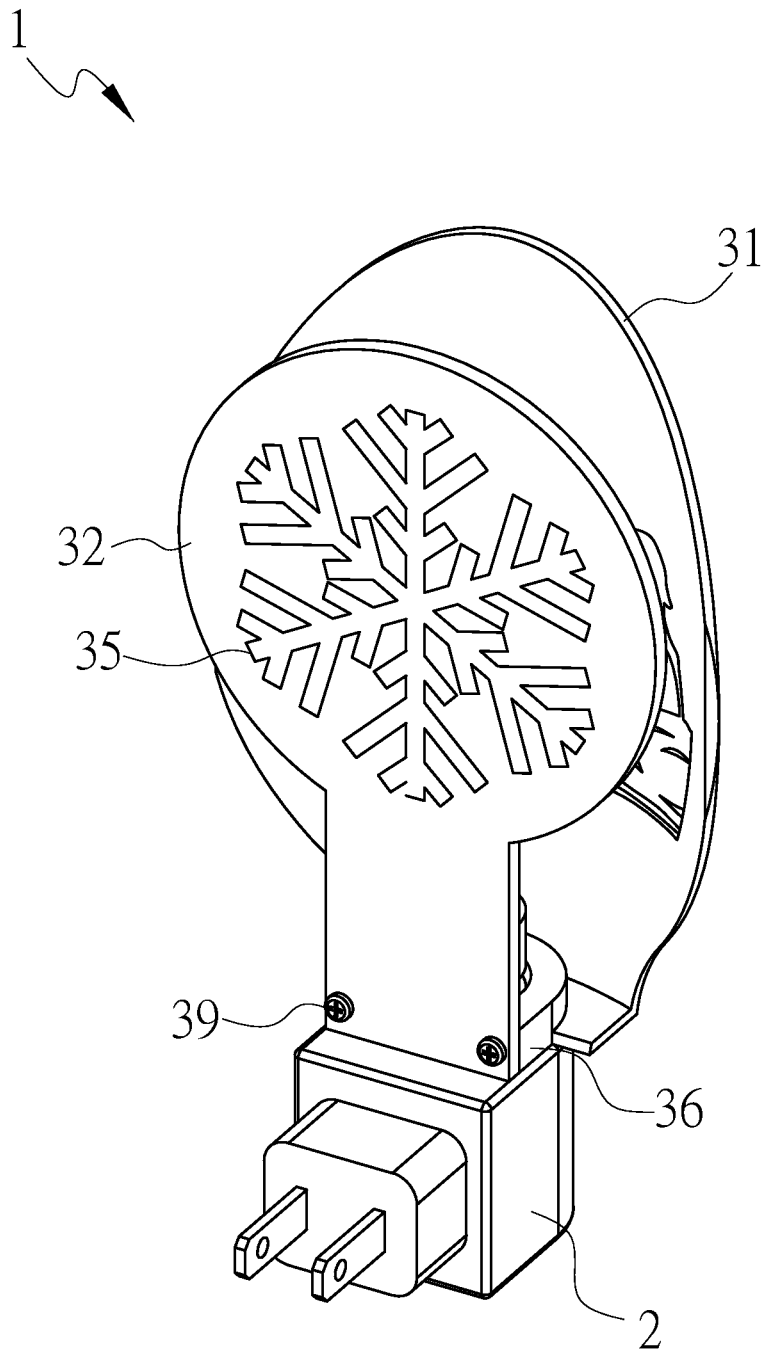
FIG. 7 is a perspective view of the embodiment of the present invention.

Referring to FIGS. 6 and 7, a manner of the cover unit 3 configured on the engagement portion 22 is described in the following. The bottom of the first decorative board 31 is extended transversely with a hole seat 36 formed into a U-typed body in engagement with the outer edge of the engagement portion 22, where the hole seat 36 is configured with two locking holes 37 spaced apart, and a through hole 38 corresponding to each locking hole 37 is configured on the bottom portion of the second decorative board 32, with a screwing element 39 being passed through each through hole 38 to fix the second decorative board 32 to the hole seat 36, allowing it to be fixed to the outer edge of the engagement portion 22.

Figure 8:
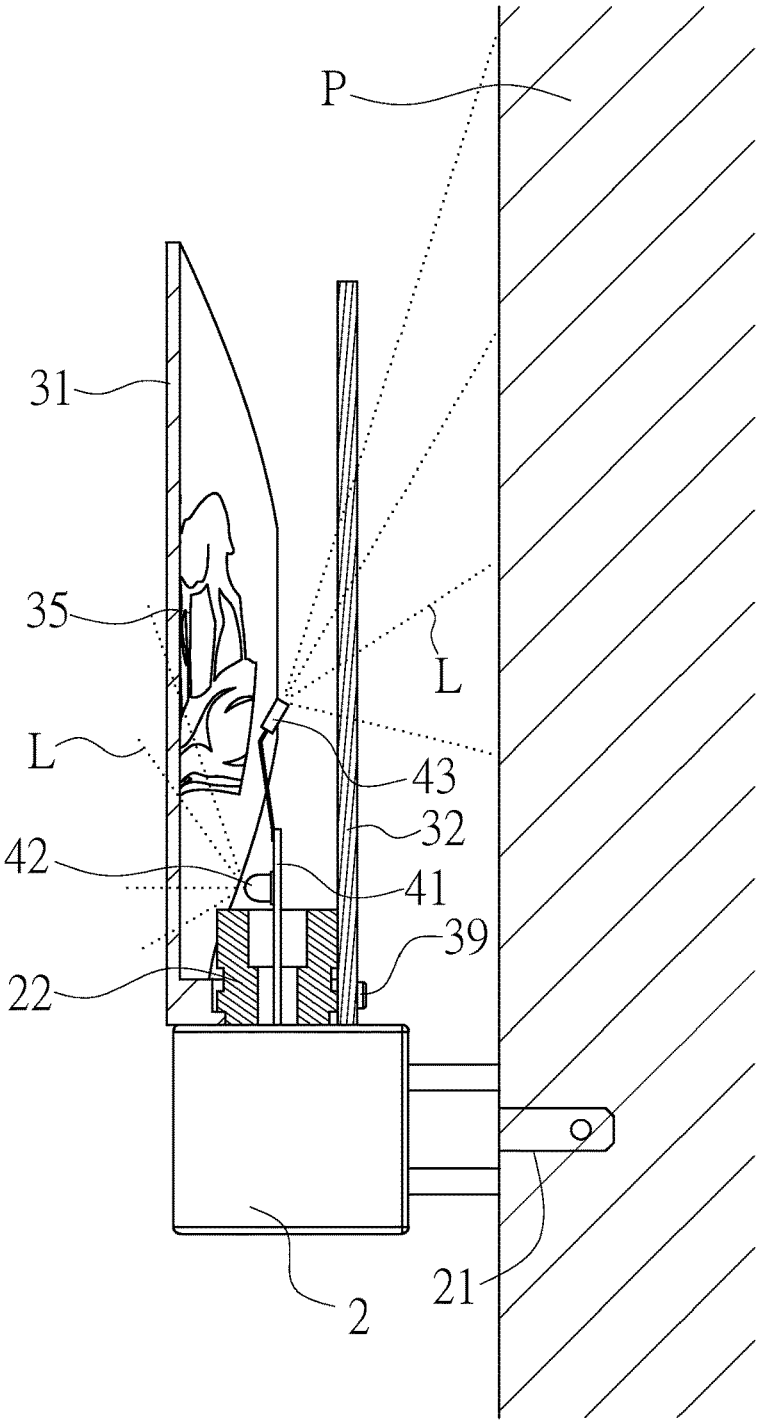
FIG. 8 shows the embodiment of the present invention in a use state.
Figure 9:
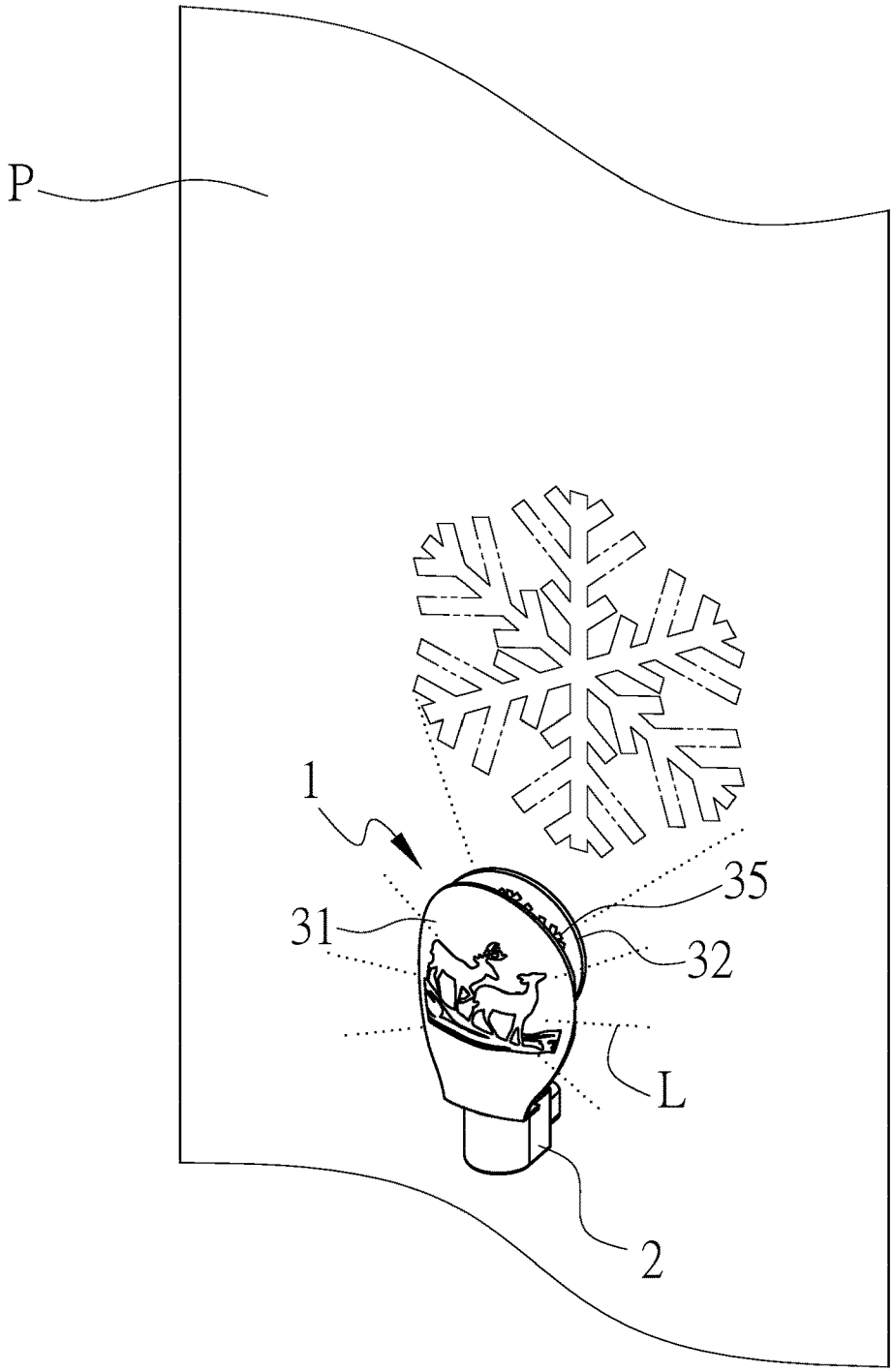
FIG. 9 shows the light projection of the present invention.

Referring to FIGS. 8 and 9, the light L generated from the first light source 42 is projected on the first decorative board 31, allowing the non-shading patterns 35 of the first decorative board 31 to be brightened and the shading pattern 35 to be more conspicuous. Furthermore, the light L generated from the second light source 43 is projected on the second decorative board 32. Since the second light source 43 is formed an angle A with the second decorative board 32. In the embodiment, the second decorative board 32 faces the wall surface P so that the non-shading patterns 35 of the second decorative board 32 can be obliquely projected onto the wall surface P, allowing the wall surface P to have an enlarged pattern image so as to decorate the wall surface P, allowing the present invention to have a double lighting effect, and further promoting product competitiveness.

Figure 10:
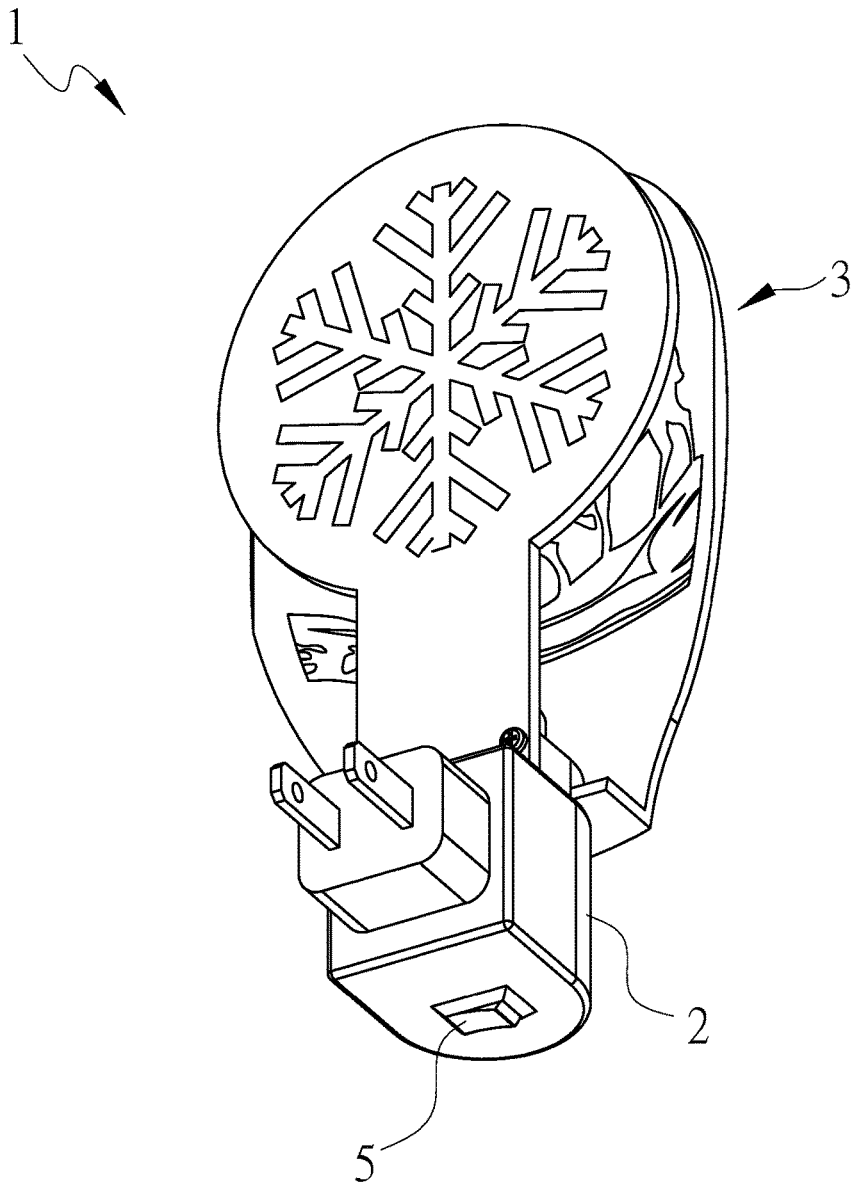
FIG. 10 is a perspective view of the present invention on which a switch is configured.

Furthermore, referring to FIG. 10, the decorative lamp further includes a switch 5 configured on the lamp seat 2 and in electric connection with the electrical terminal 21 and light emitting module 4. When the electrical terminal 21 is in contact with a power source over a long period of time, the switch 4 can be used to control the on and off of the first lamp body 222 and second lamp body 223, where the switch 5 may be a key switch, light control switch or the like, the details of which are omitted here because it is not the focus of the present invention.

I claim:

1. A double-layer decorative lamp, comprising:

a lamp seat, having an engagement portion and electrical terminal in connection with a power source to generate power;

a cover unit, having a first decorative board pervious to light and configured on said engagement portion and at least one second decorative board pervious to light and configured on said engagement portion and positioned at any side of said first decorative board, surfaces of said first decorative board and second decorative board each having a shading pattern; and a light module, having a substrate, first light source configured on said substrate and emitting light toward said first decorative board and a second light source emitting light toward said second decorative board and formed a proper angle with said surface of said second decorative board, and said substrate configured on said lamp seat and in electric connection with said electrical terminal.

2. The lamp according to claim 1, wherein said first decorative board or second decorative board is extended integrally out of said engagement portion.

3. The lamp according to claim 1, wherein said first decorative board or second decorative board is configured with a clamping portion, and said first decorative board or second decorative board is clamped on said engagement portion through said clamping portion.

4. The lamp according to claim 1, wherein said first decorative board and second decorative board are in combination with said engagement portion with at least one screwing element.

5. The lamp according to claim 1, further comprising a switch configured on said lamp seat and in electric connection with said electrical terminal and light emitting module.

6. The lamp according to claim 5, wherein said switch is light control switch.

7. The lamp according to claim 5, wherein said switch is a key switch.

8. The lamp according to claim 1, wherein said first light source and second light source respectively are a light emitting diode (LED).

* * * * *